United States Patent [19]

Jourde et al.

[11] Patent Number: 4,471,740

[45] Date of Patent: Sep. 18, 1984

[54] PREMETERED PUMP INJECTOR HAVING CONSTANT INJECTION PRESSURE, AND DERIVATIVE SYSTEM

[75] Inventors: Jean-Pierre Jourde, Lyons; Campo-Garraza Pedro, Caluire, both of France

[73] Assignee: Regie Nationale des Usines Renault, Boulogne-Billancourt, France

[21] Appl. No.: 432,979

[22] Filed: Oct. 6, 1982

[51] Int. Cl.[3] ..... F02M 57/02

[52] U.S. Cl. ..... 123/446; 239/89; 239/90

[58] Field of Search ..... 123/446, 447, 467, 458; 239/88–93, 95

[56] References Cited

U.S. PATENT DOCUMENTS

| | | | |
|---|---|---|---|
| 3,516,395 | 6/1970 | Bassot et al. | 123/446 |
| 4,249,497 | 2/1981 | Eheim et al. | 123/446 |
| 4,279,385 | 7/1981 | Straubel et al. | 239/88 |
| 4,280,464 | 7/1981 | Kanai et al. | 123/447 |
| 4,281,792 | 8/1981 | Sisson et al. | 239/90 |
| 4,297,982 | 11/1981 | Lakra | 123/446 |
| 4,385,609 | 5/1983 | Kato | 239/88 |
| 4,396,151 | 8/1983 | Kato et al. | 239/89 |
| 4,399,793 | 8/1983 | Poore et al. | 239/92 |

*Primary Examiner*—Magdalen Y. C. Moy

*Attorney, Agent, or Firm*—Oblon, Fisher, Spivak, McClelland & Maier

[57] ABSTRACT

A pump injector sends a premetered quantity of fuel to a needle type injector of the type including a piston and a discharge chamber. The injector includes a compression piston mechanically controlled by cam or eccentric having any form. The compression piston compresses fuel within a compression chamber. An injection piston is activated exclusively by the pressure within the compression chamber, opposed by an opposing return spring. The injection piston in turn compresses the fuel in an injection chamber designed to feed the injector. A pressure regulator limits the pressure in the compression chamber to a high, preset value independent of the speed and load of the engine.

4 Claims, 10 Drawing Figures

PREMETERED PUMP INJECTOR HAVING CONSTANT INJECTION PRESSURE, AND DERIVATIVE SYSTEM

BACKGROUND OF THE INVENTION

Field of the Invention

This invention relates to fuel injected engines, particularly direct fuel injection Diesel engines requiring a high injection pressure, for low speed and low load operation, i.e., for injection of small fuel quantities.

Description of the Prior Art

Adequate fuel injection pressure cannot be obtained at low speed or low load with straightline or rotary injection pumps. Conventional pump injectors yield considerably higher pressures in this range of operation, but even they are not always sufficient. Mechanical pump injectors also present great difficulties with regard to the setting of the injection advance.

SUMMARY OF THE INVENTION

The object of the invention is to overcome the above drawbacks, i.e., to construct a fuel injection device which will produce high pressures even when small fuel quantities are being injected, and which can begin injection at precisely the right moment.

The invention of combines a mechanically controlled compression piston controlled by a cam or eccentric, which compresses fuel within a compression chamber, with an injection piston activated solely by this, compressed fuel and an opposing spring. The injection piston compresses the fuel into an injection chamber communicating with the injector. A calibrated relief valve is also provided, in order to keep the pressure in the compression chamber constant during the entire compression phase, thus keeping the pressure in the injection chamber constant and independent of the motion of the compression piston during the compression phase.

The above assembly is combined with a conventional discharge chamber for rapidly closing the injection needle. A single solenoid is provided for simultaneously premetering fuel into the injection chamber and controlling the moment of injection by acting upon the discharge chamber.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
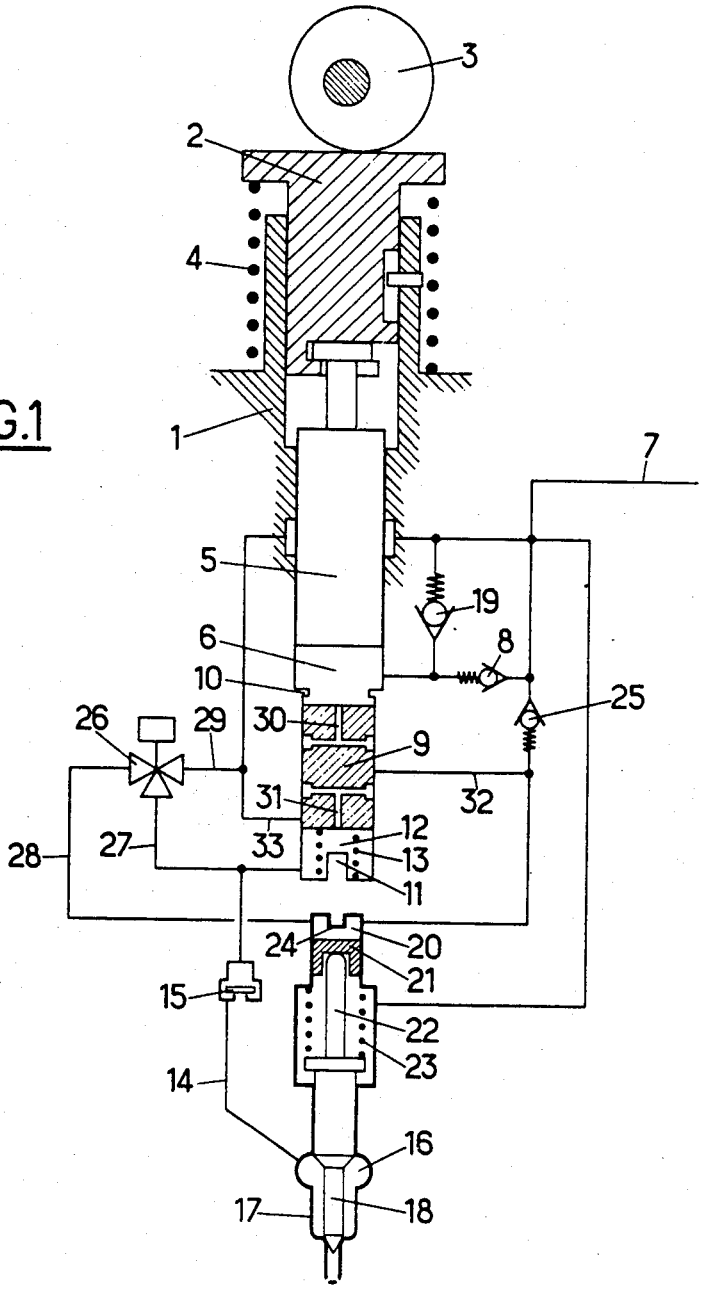
FIG. 1 is an overall schematic view of the device.

Barrel 1 of the pump injector is composed of several parts (not shown) which are assembled by appropriate known means. The barrel contains a plunger 2 which is pushed down from the top by an eccentric or cam 3 and drawn back in the opposite direction by an opposing spring 4 so as to move between a top and a bottom dead point, with the stroke possibly being further limited by stops. An appropriate opening in the plunger allows it to be fixed to the head of a compression piston 5, which thus moves with the same motion, sliding within a bore in barrel 1 and compressing fuel within a compression chamber 6 in the course of its downward strokes. In the course of the upward motions of assembly 2 and 5, fuel is admitted to compression chamber 6 by the delivery pressure arriving through line 7 and check valve 8.

In another bore or, preferably, in an axial extension of the same bore, is disposed an injection piston 9 whose stroke is limited by an upper stop 10 and lower stop 11 provided in the bottom of an injection chamber 12. The injection chamber 12 further contains an opposing return spring 13 pushing injection piston 9 toward upper stop 10.

Injection chamber 12 communicates through a channel 14, in which a flat valve 15 may be inserted, with reservoir 16 of injector 17, which is equipped with a conventional injector needle 18.

In addition, compression chamber 6 includes a pressure limiter consisting of a relief valve 19 calibrated to a high, fixed pressure. The diameter of compression piston 5 is greater by a set value than that of injection piston 9 so that whatever the speed of the engine and the path of motion defined by cam or eccentric 3, the injection pressure existing between chambers 12 and 16 can be held constant and equal to that in compression chamber 6 when injection occurs. In other words, the volume of fuel set in motion by the down stroke of compression piston 5 will always be greater than the volume of fuel set in motion by injection piston 9, in order that the pressure regulated by relief valve 19 will be held constant, thus already resolving the first problem posed. The remaining problem is to premeter the quantity of fuel to be injected and to trigger precisely the moment of injection.

For this purpose, a conventional injector 17 is used, comprising a discharge chamber 20 within which reciprocates a discharge piston 21 which, by means of a plunger 22, closes needle 18. A stop 24 in the cycloptic base of discharge chamber 20 precisely limits the rise of the needle, whose needle spring 23 permits the needle to rise only if the injection pressure in chamber 16 is sufficient and if the rise of the needle 18 is not being prevented by high pressure within discharge chamber 20. The complete volume defined by the lower surface of piston 21, along with plunger 22, the top of needle 18, and needle spring 23 is subject to the delivery pressure.

In accordance with the teachings of the invention, discharge chamber 20 is supplied with the delivery pressure passing through line 7 by virtue of another check valve 25, and a three-way solenoid 26 which may assume two positions. In the first positon, solenoid 26 connects injection chamber 12 with discharge chamber 20 through appropriate lines 27 and 28. In the second position, corresponding, for example, to the state of excitation of the solenoid, the solenoid connects discharge 20 to the delivery pressure of line 7 through a line 29, while blocking line 27 of the injection chamber.

In this way, one solenoid can simultaneously perform premetering and injection control. Metering occurs as compression piston 5 rises, with injection piston 9 rising only if solenoid 26 is in the first position, allowing fuel to arrive at injection chamber 12 through the delivery pressure. In this case, i.e., when the solenoid is in first position, the two chambers 6 and 12 are respectively fed at the delivery pressure through check valves 8 and 25, but due to the presence of opposing spring 13, the pressure in chamber 6 is greater than the pressure in chamber 12, which means that fuel cannot enter chamber 6 through check valve 8 when compression piston 5 is rising under the effect of opposing spring 4, with cam or eccentric 3 moving from its low to high dead point. The premetered quantity thus depends exclusively on the calibrated tube of the fuel delivery lines sections and on the time elapsing between the return of solenoid 26 to its initial position and the moment at which compression piston 2 reaches its high dead point. This time can be precisely controlled by means of an electronic device taking into account the speed of the engine.

On the other hand, during the descent phase of compression piston 5, and if solenoid 26 is in first position, discharge chamber 20, like injection chamber 12, is subjected to the high pressure regulated by check valve 19, so that injection will not occur as long as the solenoid is not excited into its second position. At this moment (i.e. when solenoid 26 moves into its second position), the pressure within discharge chamber 20 drops and injection ensues through line 14 under constant pressure, as seen above, for the time necessary for the premetered quantity to pass through.

As a variant, injection piston 9 is provided with channels 30 and 31, and barrel 1 with passages 32 and 33, making it possible at the end of the down stroke of injection piston 9 to connect compression chamber 6 with discharge chamber 20, on the one hand, and, on the other, to connect injection chamber 12 with the delivery pressure, which has the effect of completely releasing the pressure in injector reservoir 16 and simultaneously forcing the needle to drop so as to quickly close the injector.

Figure 2:
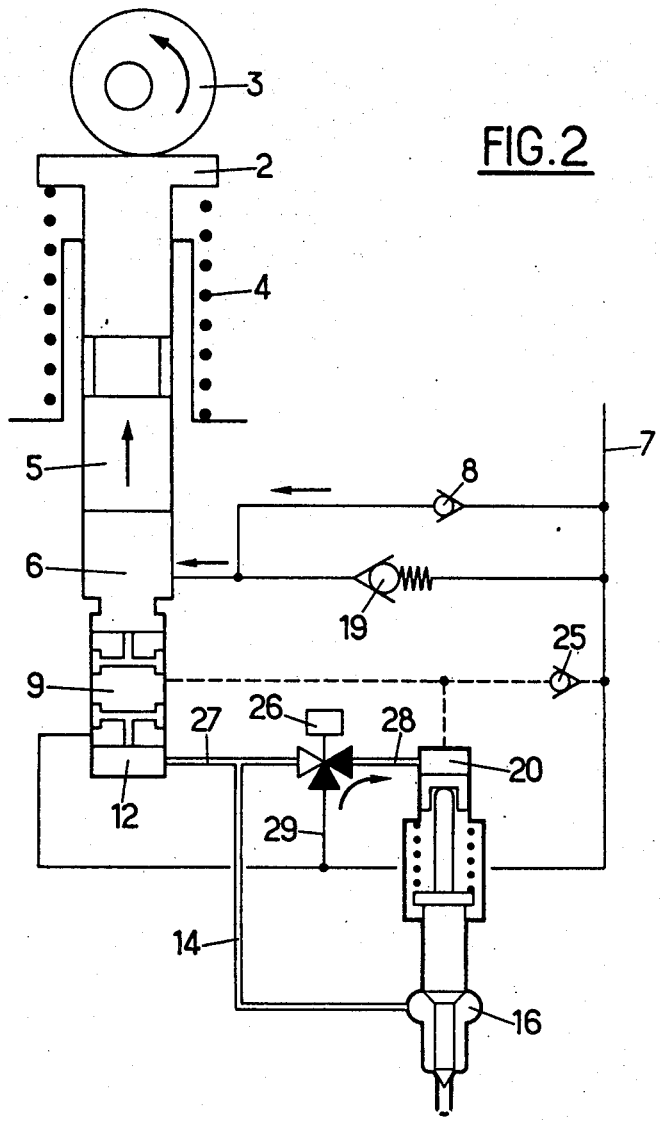
FIGS. 2 through 6 are simplified diagrams illustrating the various phases of operation of the device of FIG. 1.

The operation and various variants of the invention can be reviewed in FIGS. 2 through 6. FIG. 2 shows the beginning of the plunger's ascent, with solenoid 26 excited, allowing compression chamber 6 to be filled, while injection chamber 12 is not yet allowed to fill, since piston 9 remains sealed by solenoid 26 and thus motionless.

Figure 3:
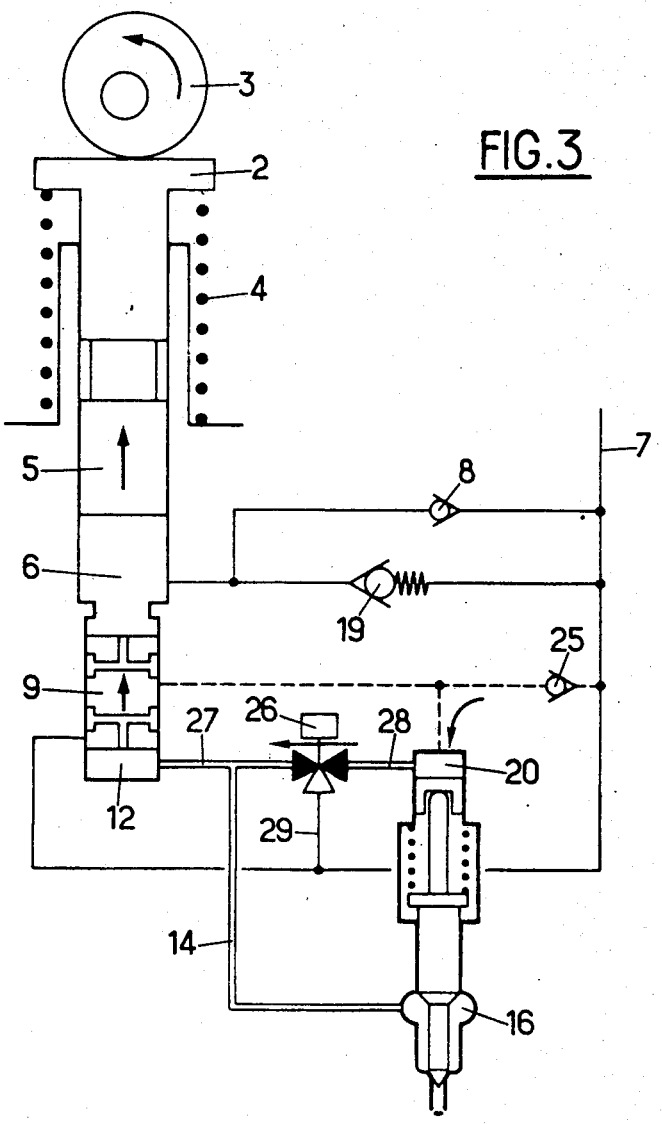

In FIG. 3, one may observe the beginning of metering, corresponding to the cutting off of power to solenoid 26, which allows fuel to enter piston 9 so that piston 9 can rise under the effect of the spring allowing premetering to proceed.

Figure 4:
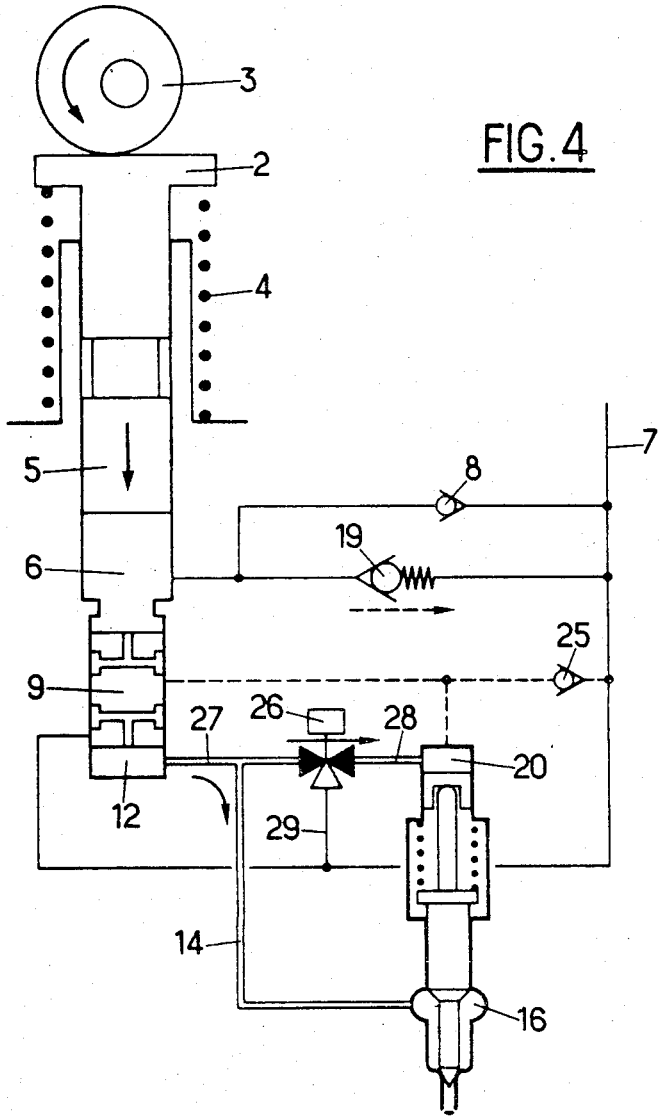

FIG. 4 corresponds to the beginning of compression and the simultaneous pressurization of compression chamber 6 and injection chamber 12, with the pressure regulated by pressure limiter 19. In this phase, needle 18 cannot rise since the same pressure exists in discharge chamber 20 as in reservoir 16.

Figure 5:
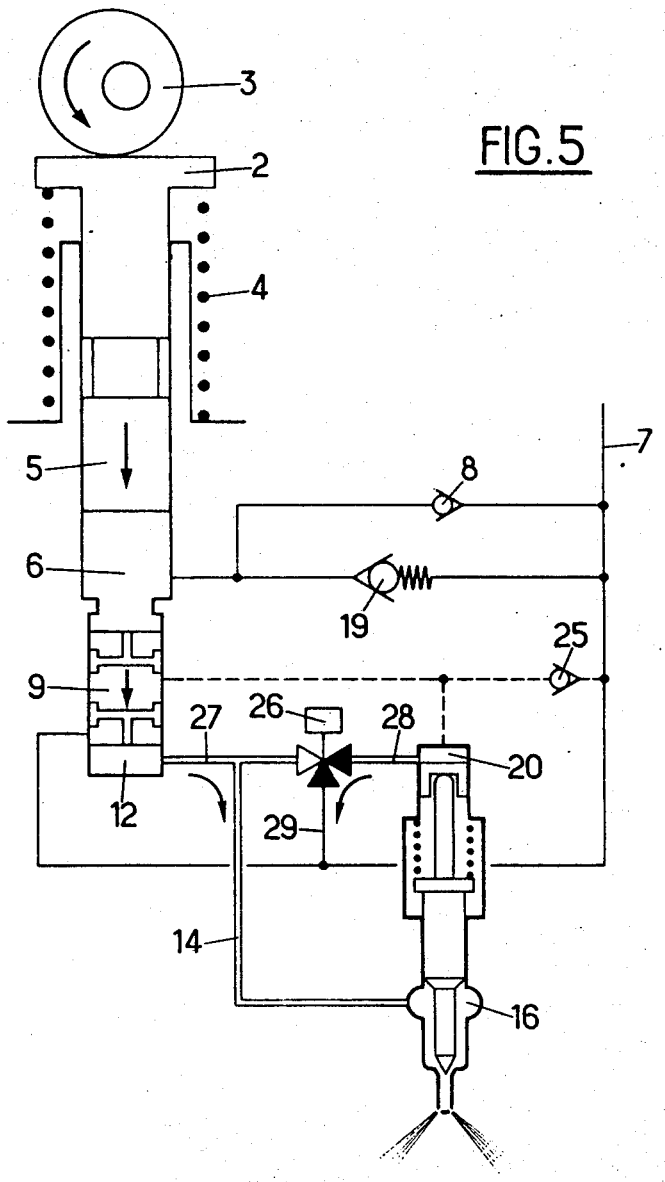

FIG. 5 corresponds to the precise moment at which injection is triggered through the excitation of solenoid 26. Discharge chamber 20 is emptied, enabling needle 18 to rise, and the premetered quantity of fuel in injection chamber 12 is injected under constant pressure, regulated by check valve 19.

Figure 6:
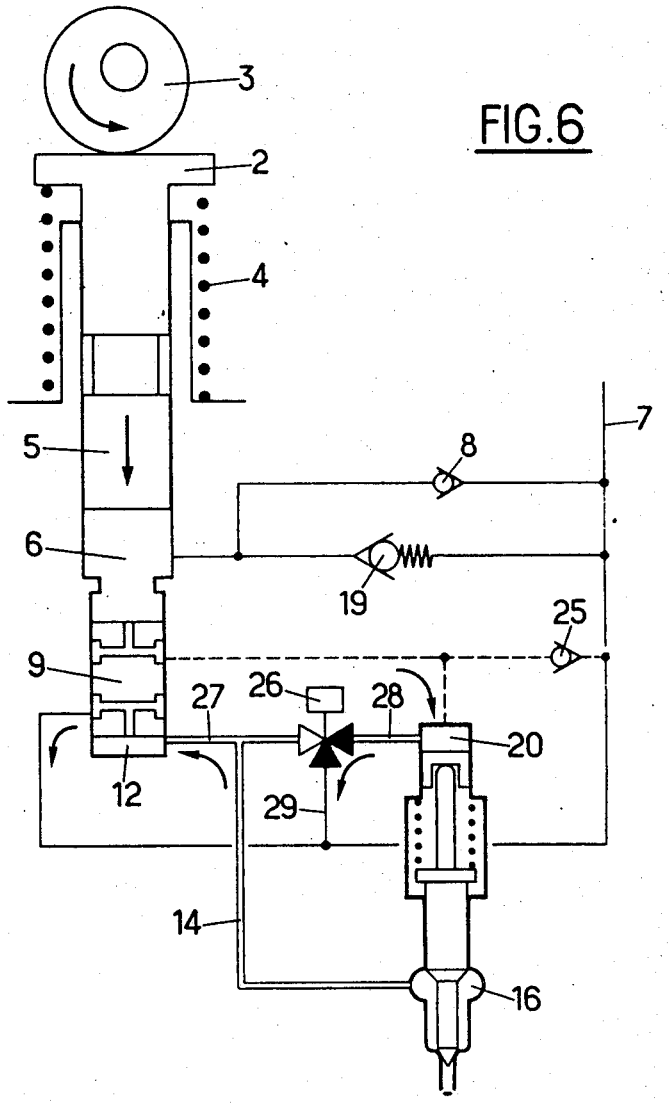

Finally, FIG. 6 corresponds to the end of the stroke of injection piston 9, which precedes the end of the stroke of piston 5, a position in which injection chamber 12 and injector reservoir 16, as well as the corresponding channels, are completely empty, while discharge chamber 20 is partially refilled by the end of the compression stroke of piston 5 within compression chamber 6. This results in the rapid reclosing of the needle.

Figure 7:
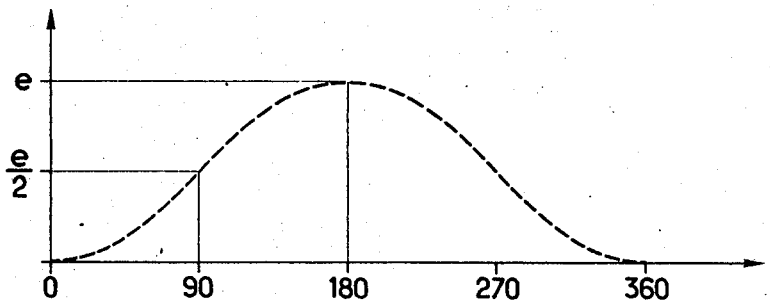
FIGS. 7 through 9 are graphs illustrating the operating cycle of the device of FIG. 1.
Figure 8:
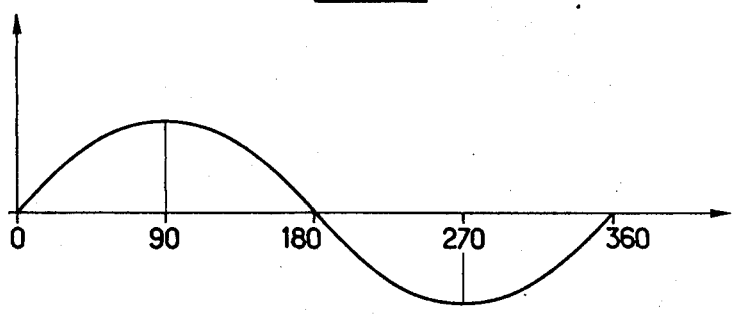

FIGS. 7 and 8 illustrate the stroke and speed curves of the plunger and of compression piston 5 (stroke "e" is in the downward direction), in the case of control by an eccentric cam imparting a sinusoidal motion, though any other motion could also be used.

Figure 9:
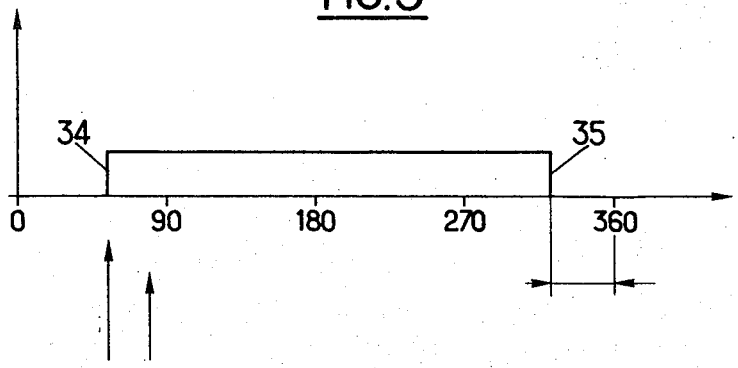

Finally, FIG. 9 illustrates the solenoid control signal as a function of the camshaft rotation cycle. It can be seen that the rising front 34 of the solenoid supply gate precisely determines the beginning of injection, with, of course, an injection advance, while the descending front corresponds to premetering, which ends with the beginning of compression. Although solenoid 26 fulfills two functions, it only receives one pulse per cycle, whose two fronts (rising and falling) are set separately and electronically as a function of the engine's operating conditions: injection advance, speed, and load.

Figure 10:
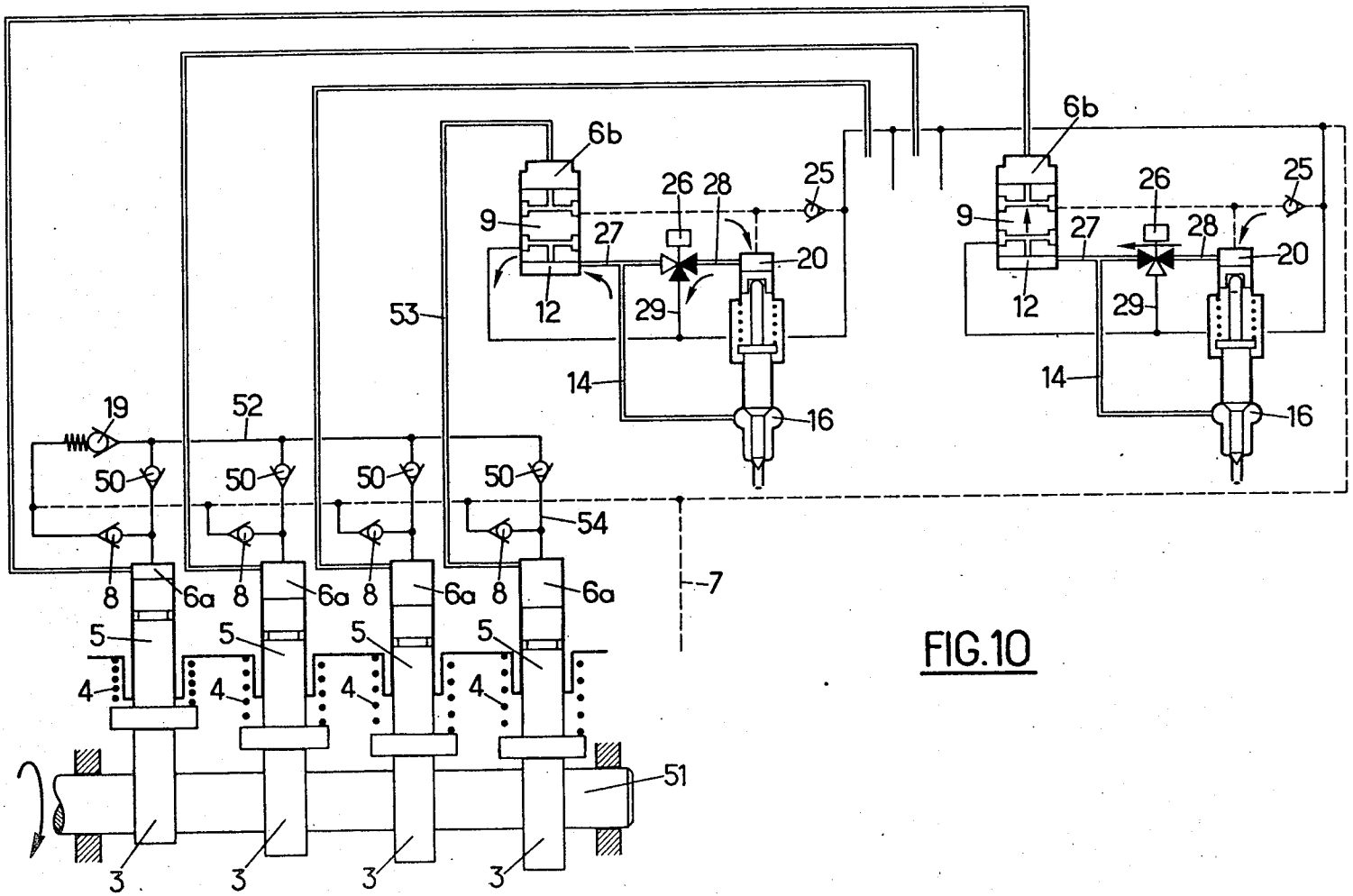
FIG. 10 is a schematic view of a variant embodiment applicable to a multicylinder engine.

The present invention relates to a pump injector, but for a multicylinder engine all of the elements, cams and eccentrics 3, opposing springs 4, and compression chambers 5 could be organized within a single body for all of the cylinders present, as shown in FIG. 10, in which the example of a four cylinder engine is taken.

Shaft 51 bearing cams or eccentrics 3 timed in accordance with the engine cycle is driven at half speed for a four cycle engine and at full speed for a two cycle engine. A compression piston 5 is connected to an injection piston 9 through a high pressure line 53 for each cam 3. Each compression chamber 6 of the pump injector is divided into two chambers **6*a* and 6*b* connected by line 53**.

The operating principle is identical to that of the pump injector of FIG. 1. The high pressure regulation alone is different. This gives an advantage to the present version compared to having several pump injectors on one multicylinder engine. In the pump injector case, relief valve 19 is integrated into the injector mount, which requires very precise and delicate calibration among several pump injector mounts in order for the (constant) injection pressures to be the same. In the present version, there is only one discharge valve 19 for a number of injector mounts. Chambers **6*a* are connected through tubes 54 and check valves 50 to a feed-rack 52, to the end of which is connected the sole relief valve 19. Valve 50 is disposed such that the high pressure in any of the chambers 6*a* may be regulated without interacting with the other chambers 6*a***.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A pump injector comprising:

first fluid cylinder means;

a compression piston in said first cylinder means, one end of said compression piston and first cylinder means defining a compression chamber;

mechanical actuation means for reciprocally moving said compression piston by a predetermined stroke;

means for supplying fuel to said compression chamber;

second fluid cylinder means;

an injection piston in said second cylinder means, one end of said injection piston and second cylinder means defining an injection chamber;

first communication means for fluid communicating a second end of said injection piston with said compression chamber;

means for biasing said injection piston in a direction enlarging said injection chamber;

a fuel injector including a reservoir having an injection outlet controlled by a reciprocating needle valve movable by a pressure differential between said reservoir and a discharge chamber;

second communication means for fluid communicating said injection chamber with said reservoir;

pressure regulator means associated with said compression chamber for limiting fluid pressure in said compression and injection chambers to a predetermined level;

third communication means for fluid communicating said injection chamber with said discharge chamber;

means for selectively closing said third communication means; and a three way solenoid valve for selectively communicating only two of said means for supplying, said discharge chamber and said compression chamber, said solenoid valve comprising said means for selectively closing said third communication means;

electric control means for selectively actuating said solenoid valve;

whereby the closure of said third communication means opens said needle valve to discharge fuel at said predetermined pressure.

2. The injector of claim 1 including a plurality of said first and second cylinder means, compression and injection pistons, compression and injection chambers, and mechanical actuation means, each said compression chambers being connected to one said second cylinder means by separate first communication means, and a single pressure regulator means for all of said compression chambers.

3. A pump injector comprising:

first fluid cylinder means;

a compression piston in said first cylinder means, one end of said compression piston and first cylinder means defining a compression chamber;

mechanical actuation means for reciprocally moving said compression piston by a predetermined stroke;

means for supplying fuel to said compression chamber;

second fluid cylinder means;

an injection piston in said second cylinder means, one end of said injection piston and second cylinder means defining an injection chamber;

first communication means for fluid communicating a second end of said injection piston with said compression chamber;

means for biasing said injection piston in a direction enlarging said injection chamber;

a fuel injector including a reservoir having an injection outlet controlled by a reciprocating needle valve movable by a pressure differential between said reservoir and a discharge chamber;

second communication means for fluid communicating said injection chamber with said reservoir;

pressure regulator means associated with said compression chamber for limiting fluid pressure in said compression and injection chambers to a predetermined level;

third communication means in said injection piston and in fluid communication with said injection chamber;

fourth communication means fluid communicating said second cylinder means with said means for supplying, said third and fourth communication means being positioned so as to communicate with one another when said injection piston is adjacent the bottom of said second cylinder means;

fifth communication means in said injection piston and in fluid communication with said compression chamber; and sixth communication means fluid communicating said second cylinder means with said discharge chamber, said fifth and sixth communication means being positioned so as to communicate with one another when said injection piston is adjacent the bottom of said second cylinder means.

4. The injector of claim 3 including a plurality of said first and second cylinder means, compression and injection pistons, compression and injection chambers, and mechanical actuation means, each said compression chamber being connected to one said second cylinder means by separate first communication means, and a single pressure regulator means for all of said compression chambers.

* * * * *